US010629392B2

(12) United States Patent
Liu et al.

(10) Patent No.: US 10,629,392 B2
(45) Date of Patent: Apr. 21, 2020

(54) UNDERWATER BUTTON SWITCH

(71) Applicant: Divevolk (Zhuhai) Intelligence Tech Co., Ltd, Zhuhai, Guangdong (CN)

(72) Inventors: Jingsong Liu, Guangdong (CN); Songdong Liu, Guangdong (CN)

(73) Assignee: Divevolk (Zhuhai) Intelligence Tech Co,, Ltd, Zhuhai (CN)

( * ) Notice: Subject to any disclaimer, the term of this patent is extended or adjusted under 35 U.S.C. 154(b) by 0 days.

(21) Appl. No.: 16/159,766

(22) Filed: Oct. 15, 2018

(65) Prior Publication Data

US 2019/0051472 A1 Feb. 14, 2019

Related U.S. Application Data

(63) Continuation of application No. PCT/CN2017/071095, filed on Jan. 13, 2017.

(51) Int. Cl.
*H01H 13/06* (2006.01)
*H01H 13/14* (2006.01)

(52) U.S. Cl.
CPC ..... *H01H 13/06* (2013.01); *H01H 13/14* (2013.01)

(58) Field of Classification Search
CPC .... G03B 17/08; A63B 2220/80; H01H 13/06; H01H 13/066; H01H 2231/044; H01H 23/06; H01H 2223/003
See application file for complete search history.

(56) References Cited

U.S. PATENT DOCUMENTS 4,006,364 A * 2/1977 Suter ..... G04F 8/08 307/119
5,298,928 A * 3/1994 Suzuki ..... G03B 17/08 396/26
5,339,124 A * 8/1994 Harms ..... G03B 17/08 396/27
5,514,843 A * 5/1996 Wilfong ..... H01H 23/02 200/18
7,426,338 B2 * 9/2008 Matsumoto ..... G03B 17/08 200/18
9,040,855 B2 * 5/2015 Werner ..... H01H 13/06 200/302.2

* cited by examiner

*Primary Examiner* — Vanessa Girardi

(57) ABSTRACT

Disclosed is a underwater high-sensitivity button switch. The underwater high-sensitivity button switch includes an upper cover, a lower cover and a hollow block; the upper cover and the lower cover are made of an elastic material; the hollow block is made of a rigid material; two ends of a through hole of the hollow block are respectively sealed by the upper cover and the lower cover; a mounting block is held in the through hole of the hollow block; the mounting block is provided with a bridge-cutoff block; the bridge-cutoff block is made of a conductive material; two unconnected lug bosses are arranged on the bridge-cutoff block; the two lug bosses are respectively connected with a conducting wire; a button fixing seat is held in the through hole of the hollow block; the button fixing seat is provided with a button cap.

19 Claims, 14 Drawing Sheets

UNDERWATER BUTTON SWITCH

CROSS-REFERENCE TO RELATED APPLICATION

The present application is a continuation application of PCT Application No. PCT/CN2017/071095 filed on Jan. 13, 2017, which claims the benefit of Chinese Patent Application No. 201620308450.1 filed on Apr. 13, 2016. The contents of all the above applications are hereby incorporated by reference in their entirety.

TECHNICAL FIELD

The present invention relates to the field of switches, and particularly relates to a novel underwater high-sensitivity button switch, which is specifically applied to the control of all underwater work/scientific research/recreation and entertainment (sports) articles.

BACKGROUND

When people are engaged in underwater work/scientific research/recreation and entertainment (sports), it is frequent to use various underwater tools and particularly an electronic product and it is inevitable to use a button switch in operation control. In order to prevent the button switch after contacting water from shorting out or causing other failures, an isolation hood is often provided for the button switch, so that not only may the button switch be operated, but the effective water resistance may also be achieved.

For a common underwater normally-open button switch, the switch which needs to be controlled by a button is arranged in a sealed housing, the button is mounted on the top of the sealed housing, a shaft of the button is penetrated through the top surface of the sealed housing and rightly faces to the switch, a sealing ring is arranged at the junction of the button and the sealed housing, and the button is rebounded via a spring.

Since there is a huge pressure difference between the inside and the outside of the sealed housing in underwater (for example, the pressure difference in 40 m underwater is 4 kg/cm$^2$) and the pressure difference varies along with the change of the diving depth, the conventional art/product structure has the following problems and defects.

In order to resist the huge pressure in underwater and not to damage the switch and a controlled underwater article thereof after water enters, the sealing ring and the shaft of the button must be in a tight fit. However, such a manner will generate a huge impedance effect to the activity of the button so that pressing of the button is labor-consuming, the resilience is inaccurate and at last the operation is wrong.

In underwater, the pressure difference between the inside and the outside of the sealed housing is very large, so it is required that the spring must have enough elasticity to resist the pressure difference. However, an excessively hard spring also easily results in that the operation of the button is inconvenient.

In light of the above two points, when the switch is pressed at a shallow water depth, it is labor-consuming to press the button. At a deep water depth, the switch cannot be reset due to the huge underwater pressure, a user completely has no feeling to trigger the switch, many false actions are caused and the task is failed.

Due to the fact that the button is frequently pressed/reset, the sealing ring and the button shaft leak easily under the huge pressure difference, the safety and the reliability are poor and the frequent maintenance and replacement bring inconvenience to the user.

Moreover, with the high requirement on the material and machining precision of the button shaft and the sealing ring, the high cost, the high manufacturing and maintenance cost and the frequent maintenance, the experience of the user is affected. Therefore, the convention art still has some defects.

SUMMARY

In view of this, in order to solve the problems in the conventional art, the present invention discloses a novel underwater high-sensitivity button switch.

The present invention solves the above problems via the following technical means.

A novel underwater high-sensitivity button switch includes an upper cover, a lower cover and a hollow block.

The upper cover and the lower cover are made of an elastic material.

The hollow block is made of a rigid material.

Two ends of a through hole of the hollow block are respectively sealed by the upper cover and the lower cover.

A bridge-cutoff block arranged horizontally and fixedly connected with the inner wall of the through hole is held in the through hole of the hollow block; the bridge-cutoff block is made of a conductive material; two unconnected lug bosses are arranged on the bridge-cutoff block; and the two lug bosses are respectively and electrically connected with an operating product.

A button cap is held in the through hole of the hollow block.

The button cap is made of a conductive material; and the button cap is positioned above the bridge-cutoff block.

A guiding apparatus for enabling the button cap to move relative to the bridge-cutoff block is held in the through hole of the hollow block, and a moving part fixedly connected with the button cap is arranged in the guiding apparatus.

The moving part drives the button cap to move relative to the bridge-cutoff block; the button cap contacts the bridge-cutoff block to implement connection of a circuit; and the button cap is separated from the bridge-cutoff block to implement disconnection of the circuit.

Two ends of the moving part are respectively propped against the inner walls of the upper cover and the inner cover; pressures that the water pressure is transferred to the two ends of the moving part via the upper cover and the lower cover are equal; and under a condition in which the moving part is stressed by the water pressure and is not stressed by other external forces, a position of the moving part is constant, that is, a distance of the button cap relative to the bridge-cutoff block is constant.

Further, a mounting block is held in the through hole of the hollow block; the mounting block is horizontally arranged and is fixedly connected with the inner wall of the through hole; and the bridge-cutoff block is fixedly arranged on the mounting block.

Further, the two lug bosses are respectively connected with a conducting wire; the conducting wires are connected with the operating product; and wire penetration holes for allowing the conducting wires to enter are provided on the hollow block.

Further, a button fixing seat is held in the through hole of the hollow block; the button fixing seat is fixedly connected with the moving part; and the button fixing seat is fixedly provided with the button cap.

Further, the guiding apparatus includes two round holes formed on the mounting block.

The moving part is two vertical rods; and the two vertical rods are simultaneously and fixedly connected with the button fixing seat.

The vertical rods are respectively held in the two round holes; and two ends of the two vertical rods are respectively propped against the inner walls of the upper cover and the lower cover.

Further, the button fixing seat is arranged at top ends of the vertical rods, and is propped against the inner wall surface of the upper cover; and wire penetration holes for allowing the conducting wires to enter are provided on the upper cover.

Further, a button block is further arranged at bottom ends of the vertical rods; and the bottom block is propped against the inner wall surface of the lower cover.

Further, a limiting block is further arranged in the through hole of the hollow block; and when the button cap is overlapped to the two lug bosses, the limiting block limits the movement of the button fixing seat and controls the degree of compaction of the button cap to the lug bosses.

Further, two vertical rods are provided; and the two vertical rods are symmetrically arranged relative to the button cap.

Further, compression springs are further arranged on sections, between the button fixing seat and the mounting block, of the vertical rods in a sleeving manner.

Further, the button cap and the bridge-cutoff block both are made of a copper material.

Further, the vertical rods, the button fixing seat and the bottom block all are made of a Polyacetal (POM) material.

Further, the upper cover and the lower cover are made of a rubber, a silica gel or a latex material.

Further, an ejector block is further arranged on the outer wall of the upper cover and rightly faces to the button cap; the ejector block is made of a rigid material; the ejector block, after being supported, presses the hollow block downward; the wall surfaces around the ejector block are deformed upward, so that the button cap is overlapped upward to the lug bosses to implement the connection of the circuit of the conducting wires.

Further, the guiding apparatus includes a first square hole formed on the mounting block.

The moving part is a square rod in a clearance fit with the square hole; and the square rod is fixedly connected with the button fixing seat.

Two ends of the square rod are respectively propped against the inner walls of the upper cover and the lower cover.

Further, the moving part in the guiding apparatus is a square frame.

The button fixing seat is arranged at the inside of the square frame.

The through hole of the hollow block is a square hole.

The square frame is horizontally arranged in the through hole of the hollow block; the sidewall surface of the square frame is in clearance fit with the inner wall of the through hole; and the mounting block and the bridge-cutoff block are positioned in a hollow portion of the square frame.

A underwater high-sensitivity button switch includes an upper cover, a lower cover and a hollow block.

The upper cover and the lower cover are made of an elastic material.

The hollow block is made of a rigid material.

Two ends of a through hole of the hollow block are respectively sealed by the upper cover and the lower cover.

A bridge-cutoff block arranged horizontally and fixedly connected with the inner wall of the through hole is held in the through hole of the hollow block; the bridge-cutoff block is made of a conductive material; two unconnected lug bosses are arranged on the bridge-cutoff block; and the two lug bosses are respectively and electrically connected with an operating product.

A button cap is held in the through hole of the hollow block.

The button cap is made of a conductive material; the button cap is positioned above the bridge-cutoff block; and the button cap contacts the bridge-cutoff block.

A guiding apparatus for enabling the button cap to move relative to the bridge-cutoff block is held in the through hole of the hollow block, and a moving part fixedly connected with the button cap is arranged in the guiding apparatus.

The moving part drives the button cap to move relative to the bridge-cutoff block; the button cap contacts the bridge-cutoff block to implement connection of a circuit; and the button cap is separated from the bridge-cutoff block to implement disconnection of the circuit.

Two ends of the moving part are respectively propped against the inner walls of the upper cover and the inner cover; pressures that the water pressure is transferred to the two ends of the moving part via the upper cover and the lower cover are equal; and under a condition in which the moving part is stressed by the water pressure and is not stressed by other external forces, a position of the moving part is constant, that is, a distance of the button cap relative to the bridge-cutoff block is constant.

Further, a mounting block is held in the through hole of the hollow block; the mounting block is horizontally arranged and is fixedly connected with the inner wall of the through hole; and the bridge-cutoff block is fixedly arranged on the mounting block.

Further, the two lug bosses are respectively connected with a conducting wire; the conducting wires are connected with the operating product; and wire penetration holes for allowing the conducting wires to enter are provided on the hollow block.

Further, a button fixing seat is held in the through hole of the hollow block; the button fixing seat is fixedly connected with the moving part; and the button fixing seat is fixedly provided with the button cap.

Further, a tensile spring is arranged between the button fixing seat and the mounting block, so that the button cap tightly contacts the bridge-cutoff block.

Further, the guiding apparatus includes two round holes formed on the mounting block.

The moving part is two vertical rods; and the two vertical rods are simultaneously and fixedly connected with the button fixing seat.

The vertical rods are respectively held in the two round holes; and two ends of the two vertical rods are respectively propped against the inner walls of the upper cover and the lower cover.

Further, the button fixing seat is arranged at top ends of the vertical rods, and is propped against the inner wall surface of the upper cover; and wire penetration holes for allowing the conducting wires to enter are provided on the upper cover.

Further, a button block is further arranged at bottom ends of the vertical rods; and the bottom block is propped against the inner wall surface of the lower cover.

A underwater high-sensitivity button switch includes an upper cover, a lower cover and a hollow block.

The upper cover and the lower cover are made of an elastic material.

The hollow block is made of a rigid material.

Two ends of a through hole of the hollow block are respectively sealed by the upper cover and the lower cover.

A mounting block is held in the through hole of the hollow block; and the mounting block is horizontally arranged and is fixedly connected with the inner wall of the through hole.

A normally open/normally closed button switch is fixedly arranged on the mounting block; the normally open/normally closed button switch is connected with a conducting wire; and a wire penetration hole for allowing the conducting wire to enter is provided on the hollow block.

A button fixing seat is held in the through hole of the hollow block; and the button fixing seat is fixedly provided with a button cap.

The button cap is positioned above the normally open/normally closed button switch.

A guiding apparatus for enabling the button cap to move relative to the normally open/normally closed button switch is held in the through hole of the hollow block, and a moving part fixedly connected with the button fixing seat is arranged in the guiding apparatus.

The moving part drives the button cap to move relative to the normally open/normally closed button switch, so that the button cap contacts or is separated from the normally open/normally closed button switch.

Two ends of the moving part are respectively propped against the inner walls of the upper cover and the inner cover; pressures that the water pressure is transferred to the two ends of the moving part via the upper cover and the lower cover are equal; and under a condition in which the moving part is stressed by the water pressure and is not stressed by other external forces, a position of the moving part is constant, that is, a distance of the button cap relative to the normally open/normally closed button switch is constant.

Compared with the conventional art, the present invention has the following advantages.

When the present invention is applied to underwater, the upper cover and the lower cover are made of an elastic material and the water pressures stressed at places where the two ends of the moving rod are respectively propped against the inner walls of the upper cover and the lower cover are equal, that is, under the condition in which the moving rod is not stressed by the external force, the effect that the moving rod is constant is implemented, the button cap on the moving rod is separated from a bridge-cutoff platform and the circuit of the conducting wires is disconnected; by pressing the moving rod on the outer wall, the moving rod drives the button cap to move, the button cap is promoted to overlap with the bridge-cutoff platform and the circuit is connected; after the moving rod is loosened, the other end of the moving rod is propped against the wall surface of a housing to restore the deformation and during the restoration, the moving rod is propped against to move, the button cap on the moving rod is separated from the bridge-cutoff platform again and the circuit is disconnected; and after the water pressures stressed at the places where the two ends of the moving rod are respectively propped against the inner walls of the upper cover and the lower cover are equal, under the condition in which the moving rod is stressed by the water pressure and is not stressed by other external forces, the position is constant again, that is, the distance of the button cap relative to the bridge-cutoff block is constant.

According to the present invention, the above defects of the conventional art/product are solved, the task failure rate of the underwater work is reduced greatly, and the convenience and the experience of the underwater recreation and entertainment (sports) are enhanced to a great extent. Moreover, the use requirements of all underwater trigger switch buttons are met and relatively good applicability and the market prospect are achieved.

BRIEF DESCRIPTION OF THE DRAWINGS

For a better understanding of the technical solutions in the embodiments of the present invention, the accompanying drawings for illustrating the embodiments are briefly described below. Apparently, the accompanying drawings in the following description illustrate only some embodiments of the present invention, and persons of ordinary skill in the art may derive other accompanying drawings based on these accompanying drawings without any creative efforts.

NUMERALS IN THE DRAWINGS

Figure 1:
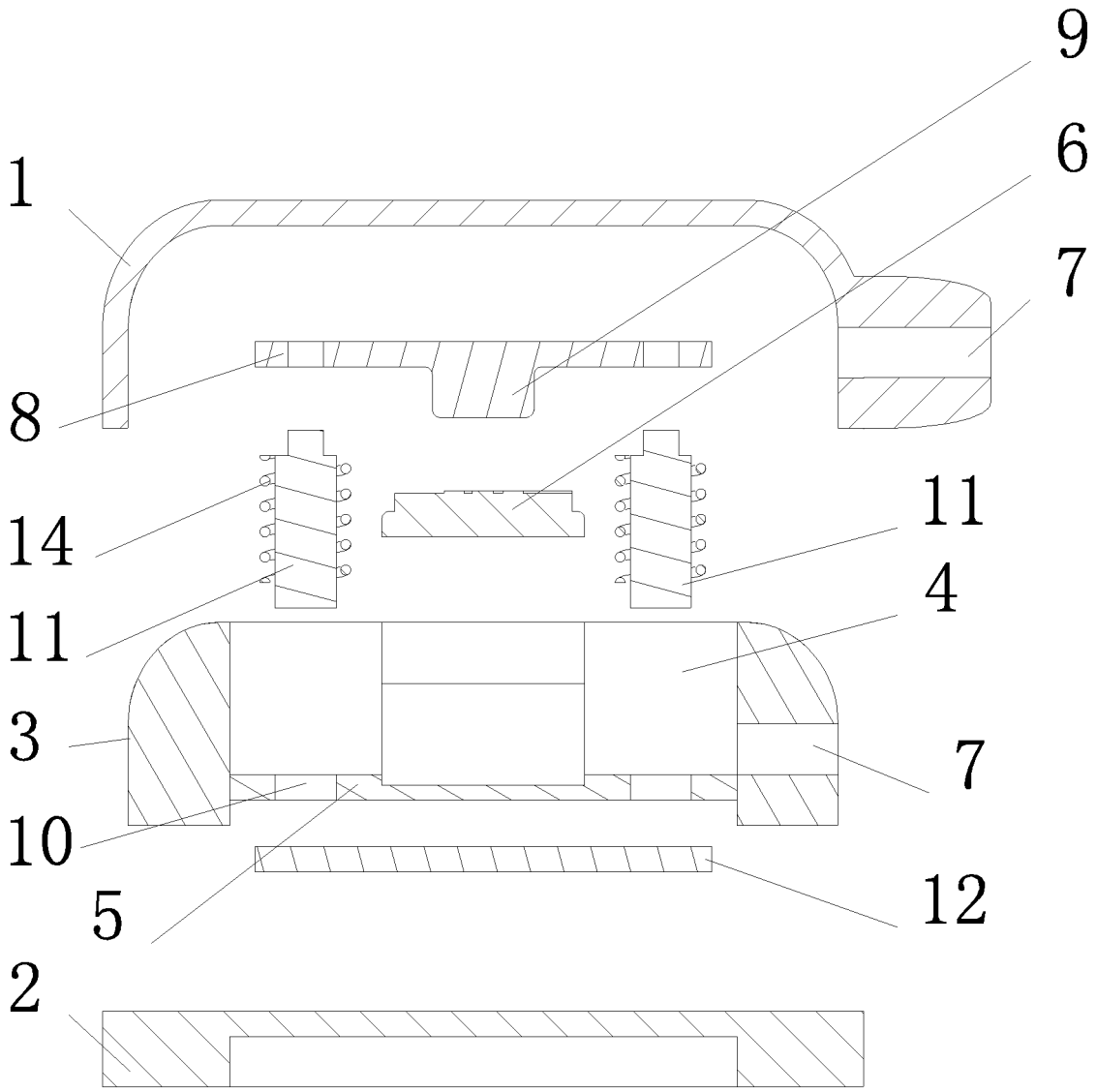
FIG. 1 is an explosive view of a first embodiment of the present invention.
Figure 2:
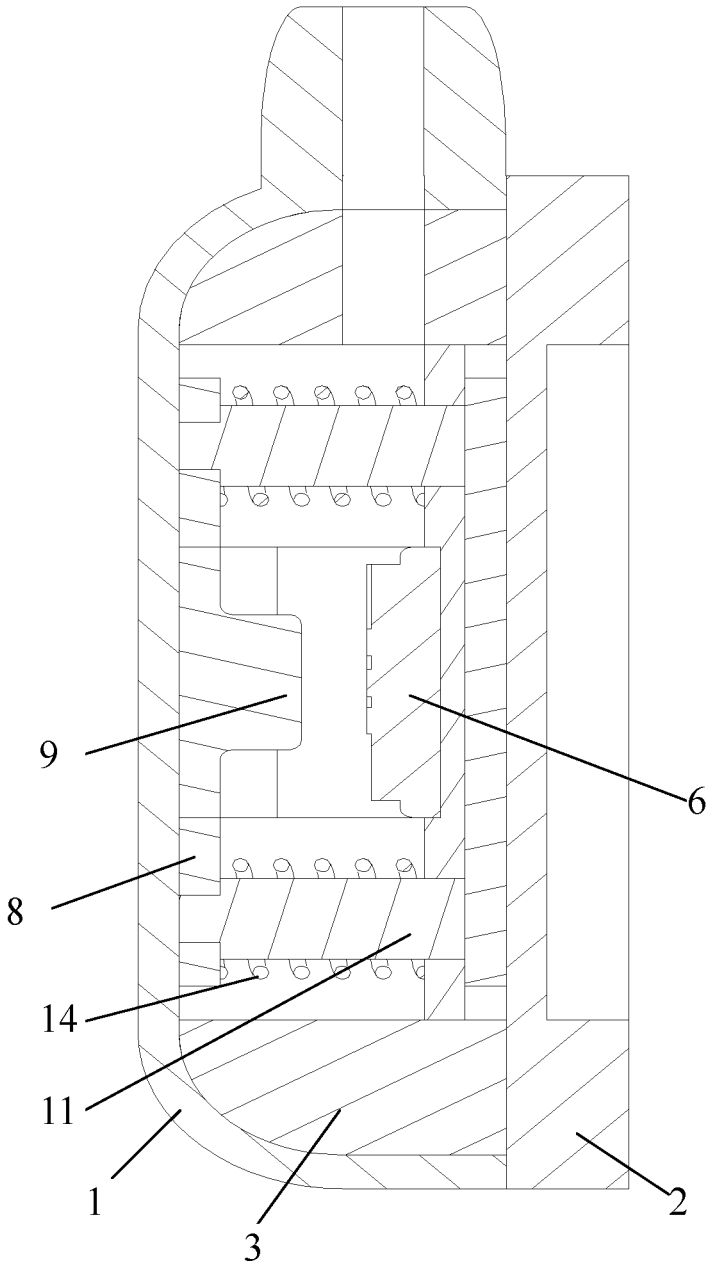
FIG. 2 is a sectional view for a front view of a first embodiment of the present invention.
Figure 3:
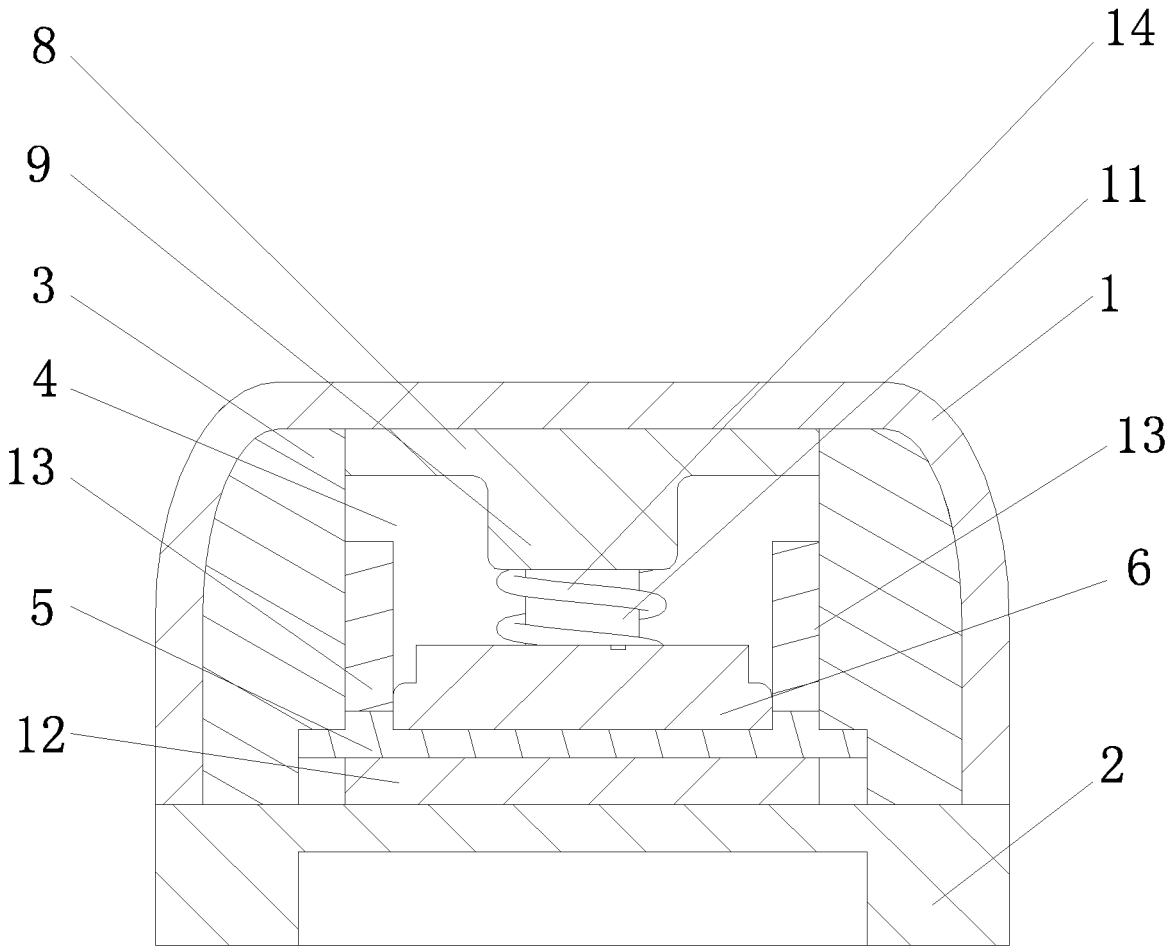
FIG. 3 is a sectional view for a right view of a first embodiment of the present invention.
Figure 4:
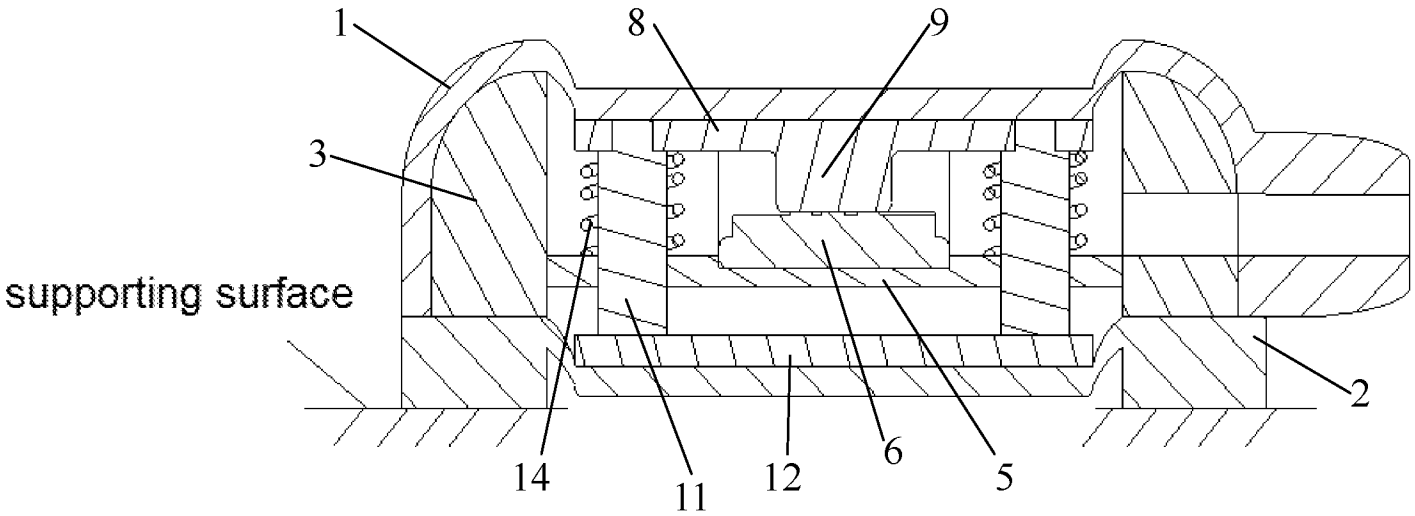
FIG. 4 is a sectional schematic diagram of a pressed state of a first embodiment of the present invention.

1. upper cover; 2. lower cover; 3. hollow block; 4. through hole; 5. mounting block; 6. bridge-cutoff block; 7. wire penetration hole; 8. button fixing seat; 9. button cap; 10. round hole; 11. vertical rod; 12. bottom block; 13. limiting block; 14. compression spring; 15. ejector block; 16. first square hole; 17. square rod; 18. square frame 19. normally open/normally closed button switch; 20. tensile spring.

DETAILED DESCRIPTION

To make the objectives, characteristics and advantages of the present invention more obvious and understandable, the technical solutions of the present invention will be illustrated in detail with reference to the accompanying drawings and specific embodiments. It is to be noted that the described embodiments are a part rather than all of the embodiments of the present invention. All other embodiments obtained by a person of ordinary skill in the art based on the embodiments of the present invention without creative efforts shall fall within the protection scope of the present invention.

It is to be noted that, all directional indications (such as upper, lower, left, right, front and rear . . . ) in the embodiments of the present invention are only intended to explain a relative positional relationship, a movement condition and the like of each component under some special posture (as shown in the accompanying drawings). If the special posture changes, the directional indication will also change correspondingly. In addition, as used herein, the terms "first" and "second" are only used to describe, rather than to understand as indication or implication of importance or to imply the number of the indicated technical characteristics. Therefore, the characteristics defined by "first" and "second" may explicitly or implicitly include at least one of the characteristics.

Embodiment 1

As shown in FIG. 1-4, a underwater high-sensitivity button switch includes an upper cover 1, a lower cover 2 and a hollow block 3.

The upper cover 1 and the lower cover 2 are made of an elastic material.

The hollow block 3 is made of a rigid material.

Two ends of a through hole 4 of the hollow block 3 are respectively sealed by the upper cover 1 and the lower cover 2.

A bridge-cutoff block 6 arranged horizontally and fixedly connected with the inner wall of the through hole 4 is held in the through hole 4 of the hollow block 3; the bridge-cutoff block 6 is made of a conductive material; two unconnected lug bosses are arranged on the bridge-cutoff block 6; and the two lug bosses are respectively and electrically connected with an operating product.

A button cap 9 is held in the through hole 4 of the hollow block 3.

The button cap 9 is made of a conductive material; and the button cap 9 is positioned above the bridge-cutoff block 6.

A guiding apparatus for enabling the button cap 9 to move relative to the bridge-cutoff block 6 is held in the through hole 4 of the hollow block 3, and a moving part fixedly connected with the button cap 9 is arranged in the guiding apparatus.

The moving part drives the button cap 9 to move relative to the bridge-cutoff block 6; the button cap contacts the bridge-cutoff block 6 to implement connection of a circuit; and the button cap is separated from the bridge-cutoff block 6 to implement disconnection of the circuit.

Two ends of the moving part are respectively propped against the inner walls of the upper cover 1 and the inner cover 2; pressures that the water pressure is transferred to the two ends of the moving part via the upper cover 1 and the lower cover 2 are equal; and under a condition in which the moving part is stressed by the water pressure and is not stressed by other external forces, a position of the moving part is constant, that is, a distance of the button cap 9 relative to the bridge-cutoff block 6 is constant.

When the present invention is applied to underwater, the upper cover 1 and the lower cover 2 are made of an elastic material and the water pressures stressed at places where the two ends of the moving rod are respectively propped against the inner walls of the upper cover 1 and the lower cover 2 are equal, that is, under the condition in which the moving rod is not stressed by the external force, the effect that the moving rod is constant is implemented, the button cap 9 on the moving rod is separated from a bridge-cutoff platform and the circuit of the conducting wires is disconnected; by pressing the moving rod on the outer wall, the moving rod drives the button cap 9 to move, the button cap 9 is promoted to overlap with the bridge-cutoff platform and the circuit is connected; after the moving rod is loosened, the other end of the moving rod is propped against the wall surface of a housing to restore the deformation and during the restoration, the moving rod is propped against to move, the button cap 9 on the moving rod is separated from the bridge-cutoff platform again and the circuit is disconnected; and after the water pressures stressed at the places where the two ends of the moving rod are respectively propped against the inner walls of the upper cover 1 and the lower cover 2 are equal, under the condition in which the moving rod is stressed by the water pressure and is not stressed by other external forces, the position is constant again, that is, the distance of the button cap 9 relative to the bridge-cutoff block 6 is constant.

Preferably, a mounting block 5 is held in the through hole 4 of the hollow block 3; the mounting block 5 is horizontally arranged and is fixedly connected with the inner wall of the through hole 4; and the bridge-cutoff block 6 is fixedly arranged on the mounting block 5.

Preferably, the two lug bosses are respectively connected with a conducting wire; the conducting wires are connected with the operating product; and wire penetration holes 7 for allowing the conducting wires to enter are provided on the hollow block 3.

Preferably, a button fixing seat 8 is held in the through hole 4 of the hollow block 3; the button fixing seat 8 is fixedly connected with the moving part; and the button fixing seat 8 is fixedly provided with the button cap 9.

Further, the guiding apparatus includes two round holes 10 formed on the mounting block 5.

The moving part is two vertical rods 11, and the two vertical rods 11 are simultaneously and fixedly connected with the button fixing seat 8.

The vertical rods 11 are respectively held in the two round holes 10; and two ends of the two vertical rods 11 are respectively propped against the inner walls of the upper cover 1 and the lower cover 2.

Preferably, the button fixing seat 8 is arranged at top ends of the vertical rods 11, and is propped against the inner wall of the upper cover 1; and wire penetration holes 7 for allowing the conducting wires to enter are provided on the upper cover 1. By pressing the button fixing seat 8 on the outer wall of a housing, the vertical rods 11 are driven to move; the pressure stressed by a finger to press the button fixing seat 8 is smaller than that stressed by the finger to press the vertical rods 11, so the operation comfort is good and the vertical rods 11 are controlled better than the finger pressing to move simultaneously.

Preferably, a button block 12 is further arranged at bottom ends of the vertical rods 11; and the bottom block 12 is propped against the inner wall surface of the lower cover 2. The deformation generated by the vertical rods 11 to prop against the wall surface of the lower cover 2 by using the bottom block 12 is greater than that generated by the bottom ends of the vertical rods 11, so the returning of the vertical rods 11 is faster after the pressing is loosened.

Preferably, a limiting block 13 is further arranged in the through hole 4 of the hollow block 3; and when the button cap 9 is overlapped to the two lug bosses, the limiting block 13 limits the movement of the button fixing seat 8 and controls the degree of compaction of the button cap 9 to the lug bosses. The damage of mutual collision between the button cap 9 and the lug bosses is controllable, so the service life of each of the button cap 9 and the lug bosses can be prolonged.

Preferably, two vertical rods 11 are provided; and the two vertical rods 11 are symmetrically arranged relative to the button cap 9. Compression springs 14 are propped against the button fixing seat 8, so the returning of the vertical rods 11 is faster.

Preferably, the compression springs 14 are further arranged on sections, between the button fixing seat 8 and the mounting block 5, of the vertical rods 11 in a sleeving manner.

Further, the button cap 9 and the bridge-cutoff block 6 both are made of a copper material.

Preferably, the vertical rods 11, the button fixing seat 8 and the bottom block 12 all are made of a POM material. The vertical rods 11, the button fixing seat 8 and the bottom block 12 are light in weight, so the deformation required by returning of the vertical rods 11 is reduced, the descending distance by pressing with a thumb can be reduced and the operation is more labor-saving.

Preferably, the upper cover 1 and the lower cover 2 are made of a rubber, a silica gel or a latex material.

Embodiment 2

Figure 5:
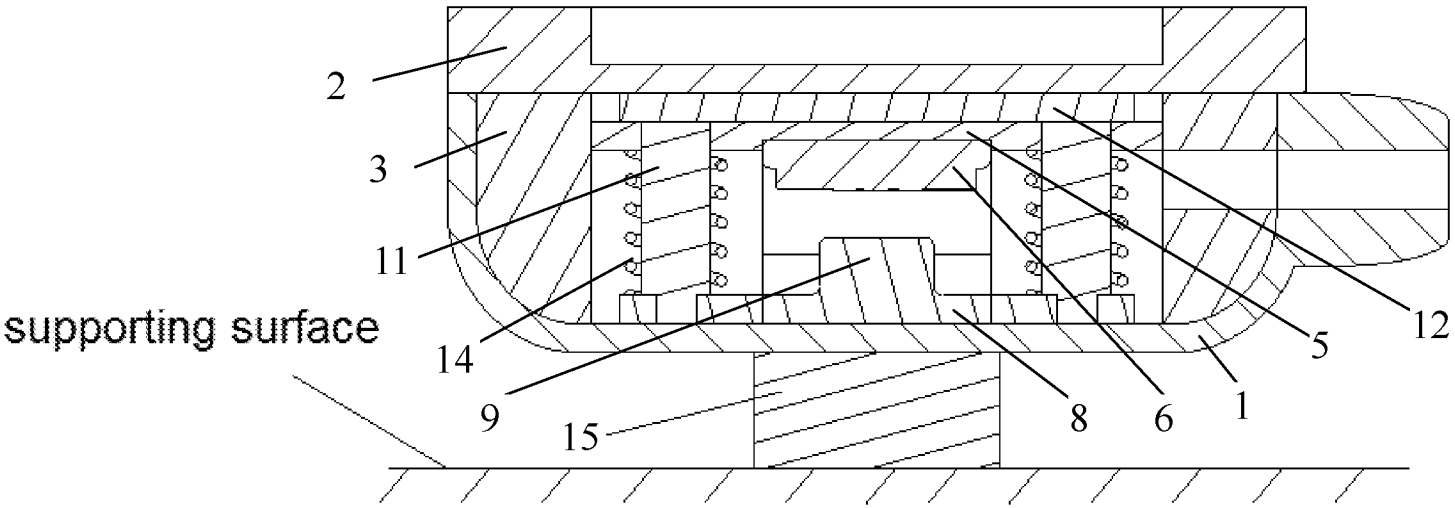
FIG. 5 is a sectional view for a front view of a second embodiment of the present invention.
Figure 6:
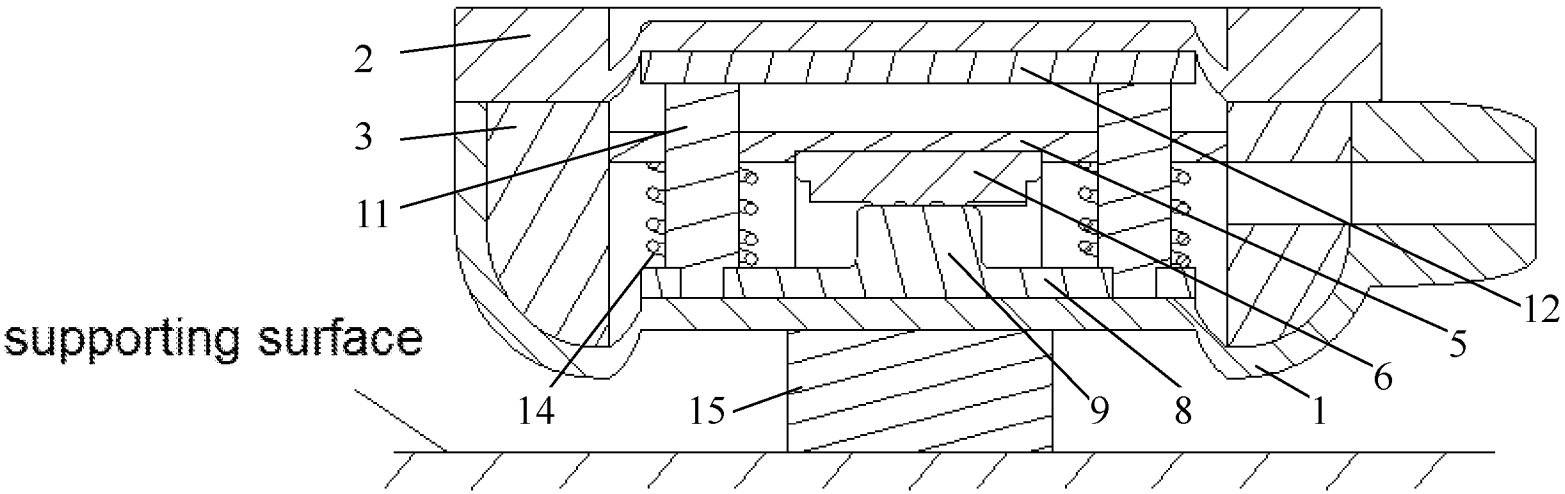
FIG. 6 is a sectional schematic diagram of a pressed state of a second embodiment of the present invention.

As shown in FIG. 5-6, the sole difference between the second embodiment and the first embodiment is that an ejector block 15 is further arranged on the outer wall of the upper cover 1 and rightly faces to the button cap 9; the ejector block 15 is made of a rigid material; the ejector block 15, after being supported, presses the hollow block 3 downward; the wall surfaces around the ejector block 15 are deformed upward, so that the button cap 9 is overlapped upward to the lug bosses to implement the connection of the circuit of the conducting wires.

Embodiment 3

Figure 7:
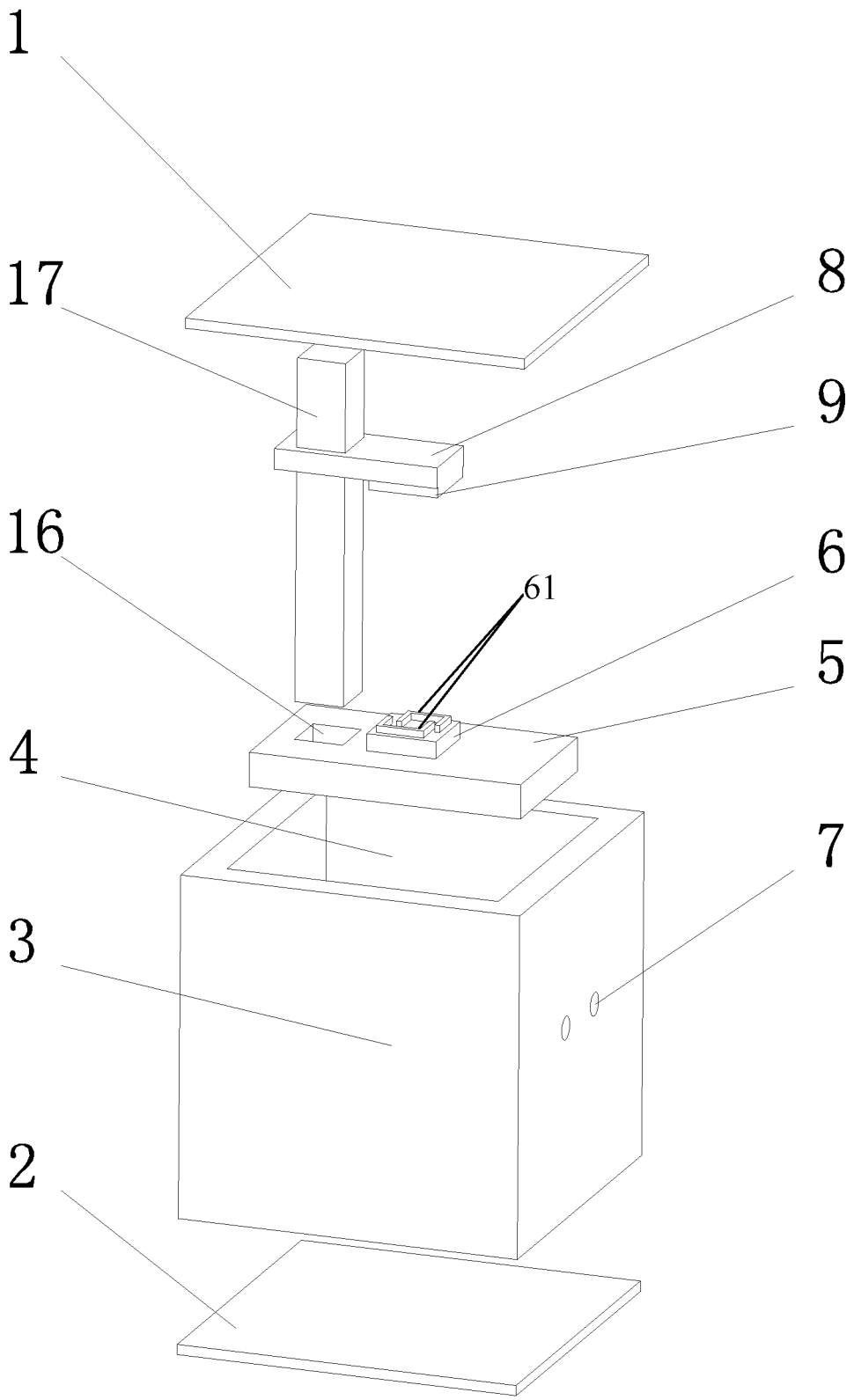
FIG. 7 is an explosive view of a third embodiment of the present invention.
Figure 8:
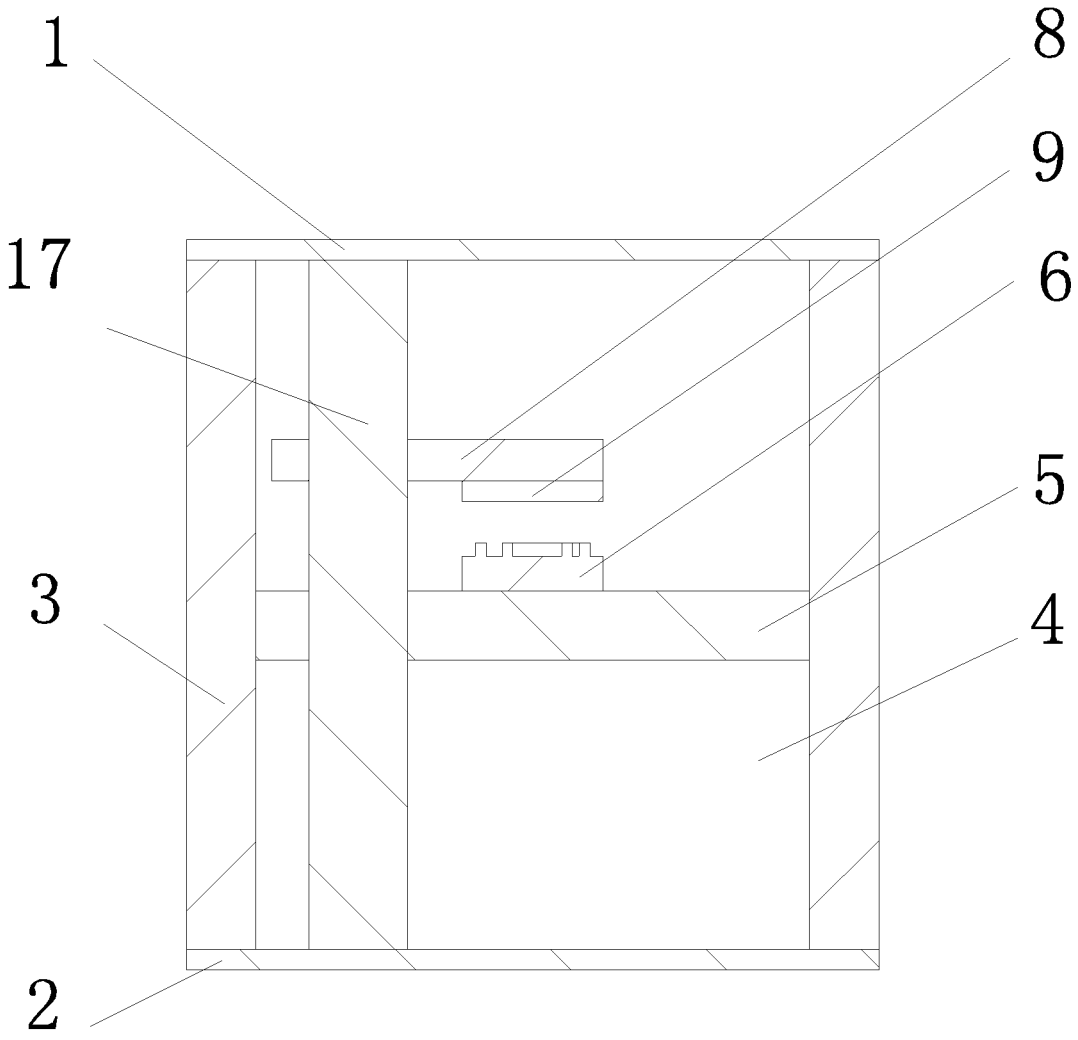
FIG. 8 is a sectional view for a front view of a third embodiment of the present invention.
Figure 9:
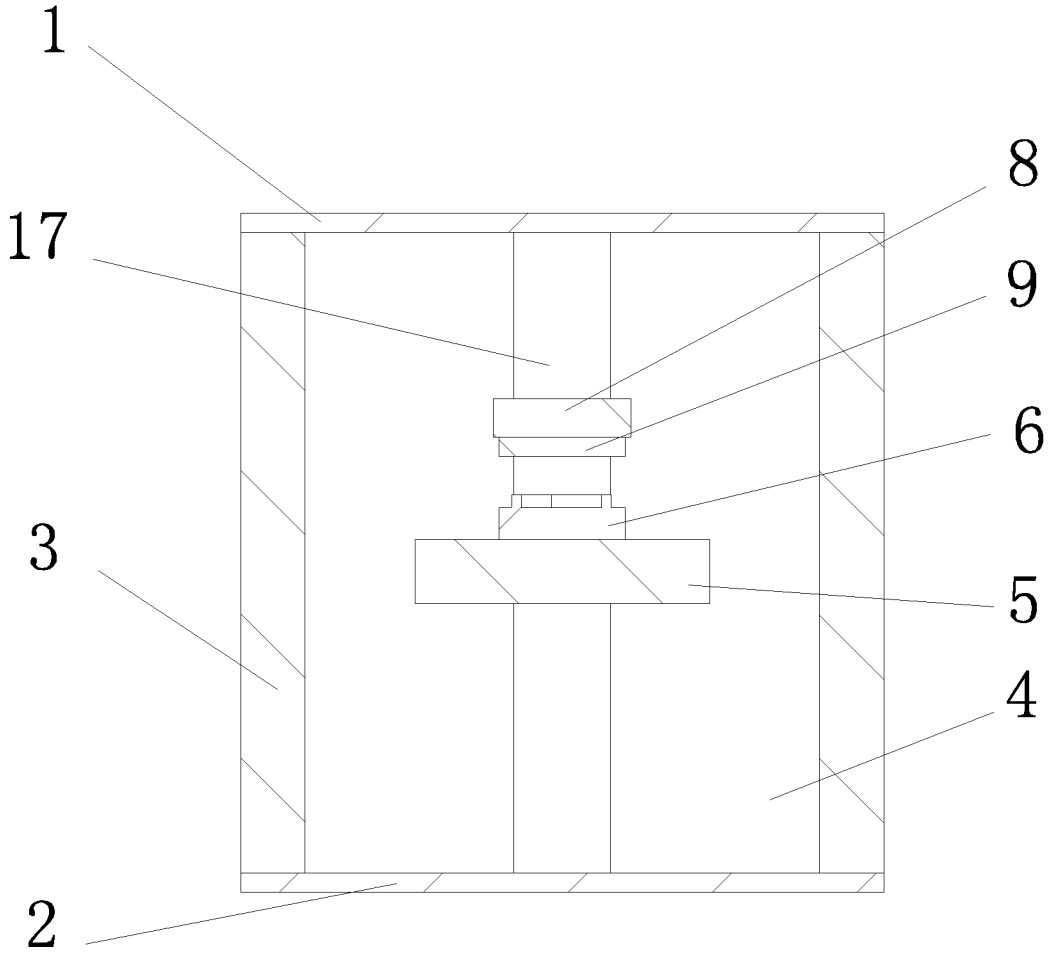
FIG. 9 is a sectional view for a left view of a third embodiment of the present invention.

As shown in FIG. 7-9, the sole difference between the third embodiment and the first embodiment is that the guiding apparatus includes a first square hole 16 formed on the mounting block 5.

The moving part is a square rod 17 in a clearance fit with the square hole, and the square rod 17 is fixedly connected with the button fixing seat 8.

Two ends of the square rod 17 are respectively propped against the inner walls of the upper cover 1 and the lower cover 2.

The square rod 17 drives the button cap 9 to move relative to the bridge-cutoff block 6 under the guidance of the first square hole 16; and after the water pressures stressed at the places where upper and lower ends of the square rod 17 are respectively propped against the inner walls of the upper cover 1 and the lower cover 2 are equal, under a condition in which the moving rod is stressed by the water pressures and is not stressed by other external forces, the position is constant again, that is, a distance of the button cap 9 relative to the bridge-cutoff block 6 is constant.

Embodiment 4

Figure 10:
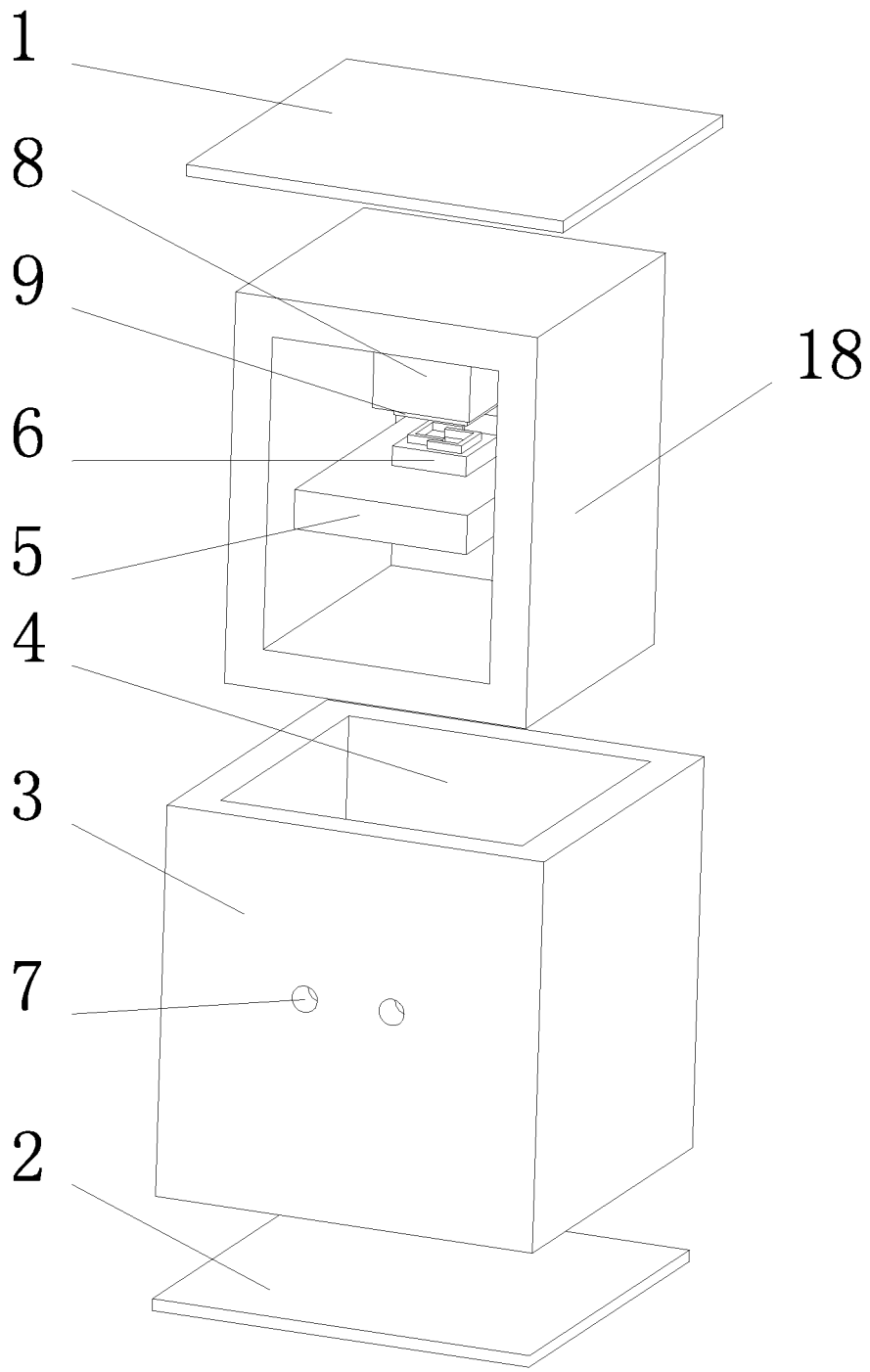
FIG. 10 is an explosive view of a fourth embodiment of the present invention.
Figure 11:
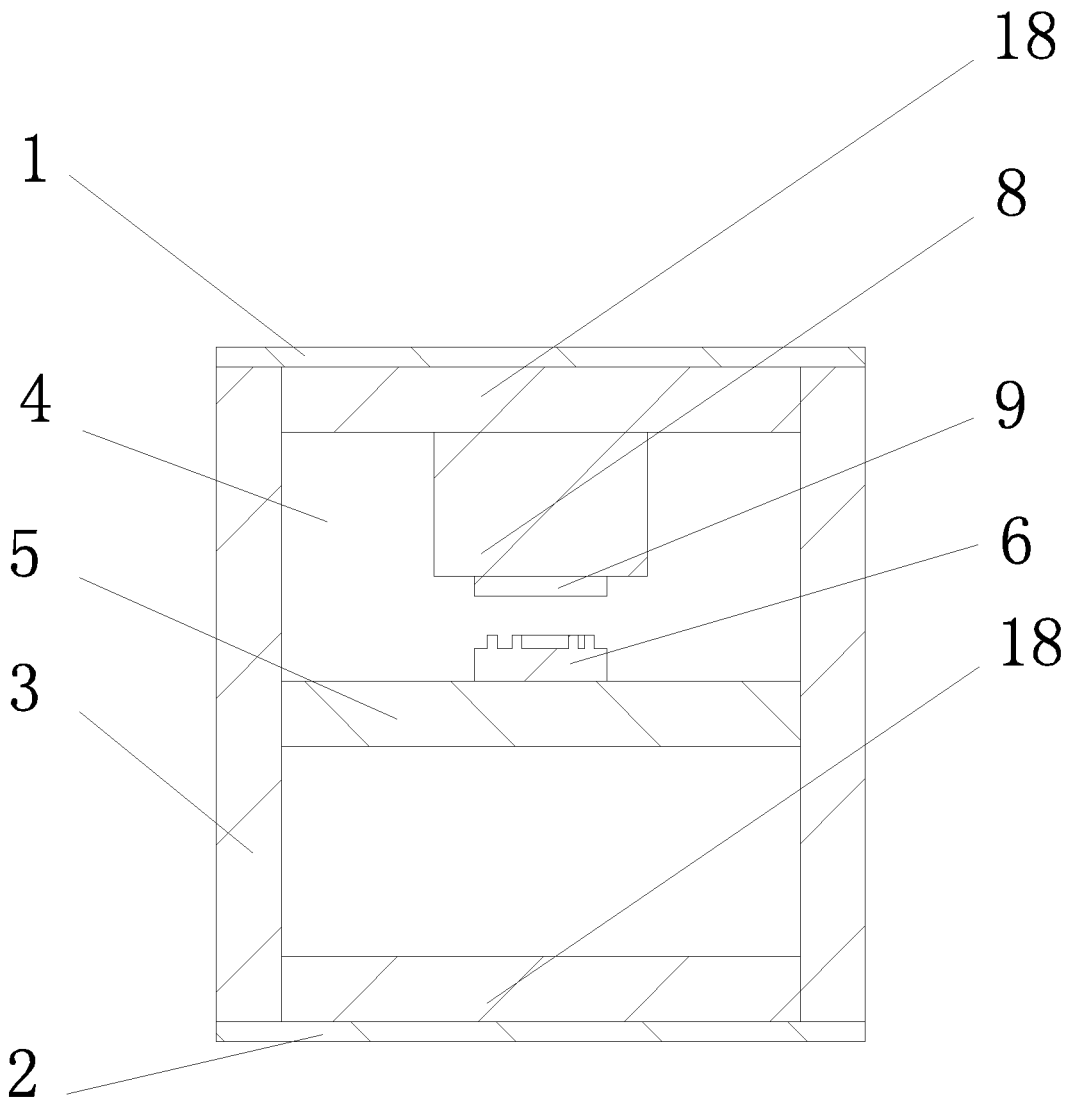
FIG. 11 is a sectional view for a front view of a fourth embodiment of the present invention.
Figure 12:
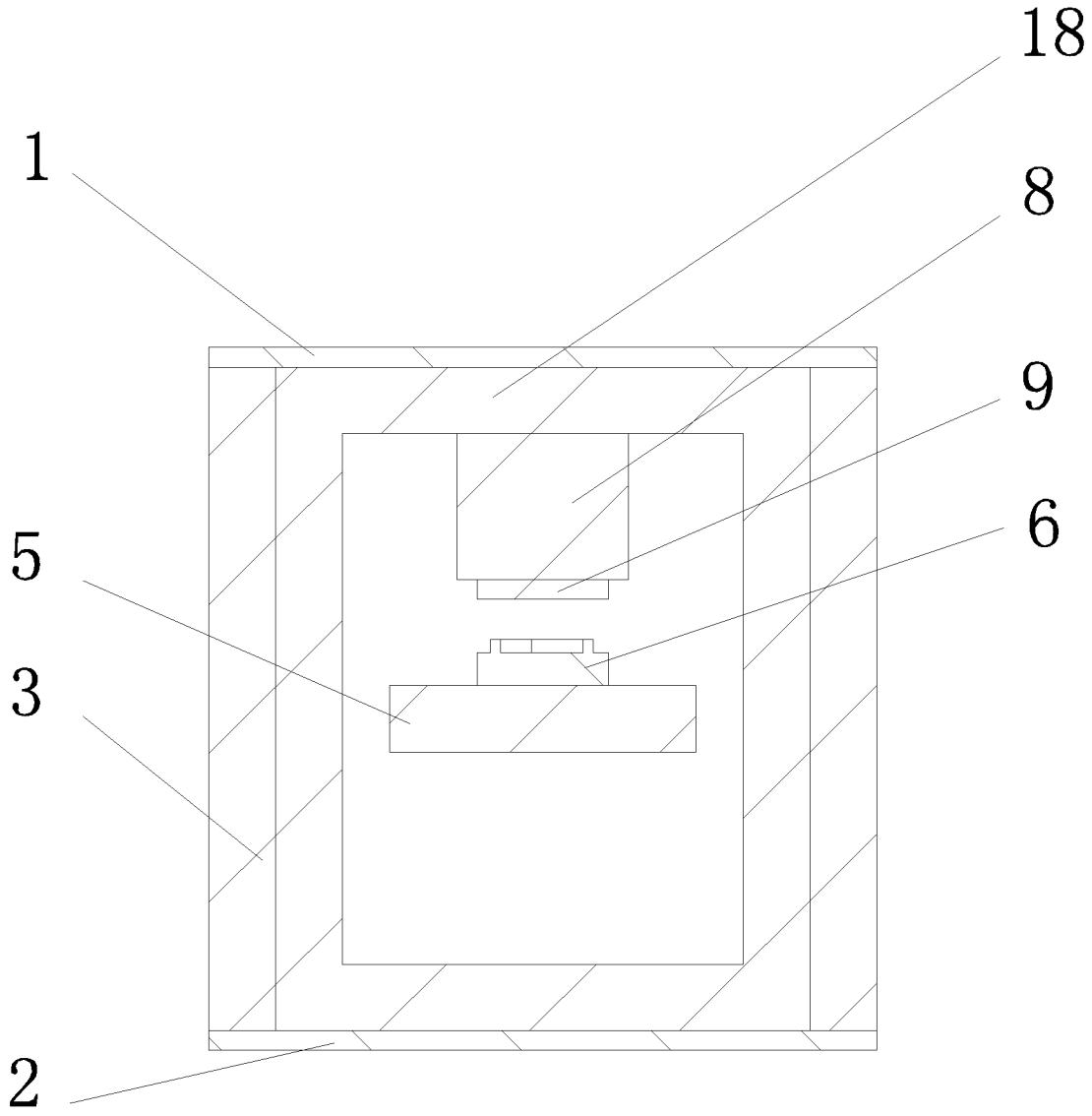
FIG. 12 is a sectional view for a left view of a fourth embodiment of the present invention.

As shown in FIG. 10-12, the sole difference between the fourth embodiment and the first embodiment is that the moving part in the guiding apparatus is a square frame 18.

The button fixing seat 8 is arranged at the inside of the square frame 18.

The through hole 4 of the hollow block 3 is a square hole.

The square frame 18 is horizontally arranged in the through hole 4 of the hollow block 3; the sidewall surface of the square frame 18 is in clearance fit with the inner wall of the through hole 4; and the mounting block 5 and the bridge-cutoff block 6 are positioned in a hollow portion of the square frame 18.

The square frame 18 drives the button cap 9 to move linearly relative to the bridge-cutoff block 6 under the guidance of the inner wall of the through hole 4; and after the water pressures stressed at the places where upper and lower ends of the square frame 18 are respectively propped against the inner walls of the upper cover 1 and the lower cover 2 are equal, under a condition in which the square frame 18 is stressed by the water pressures and is not stressed by other external forces, the position is constant again, that is, a distance of the button cap 9 relative to the bridge-cutoff block 6 is constant.

Embodiment 5

Figure 13:
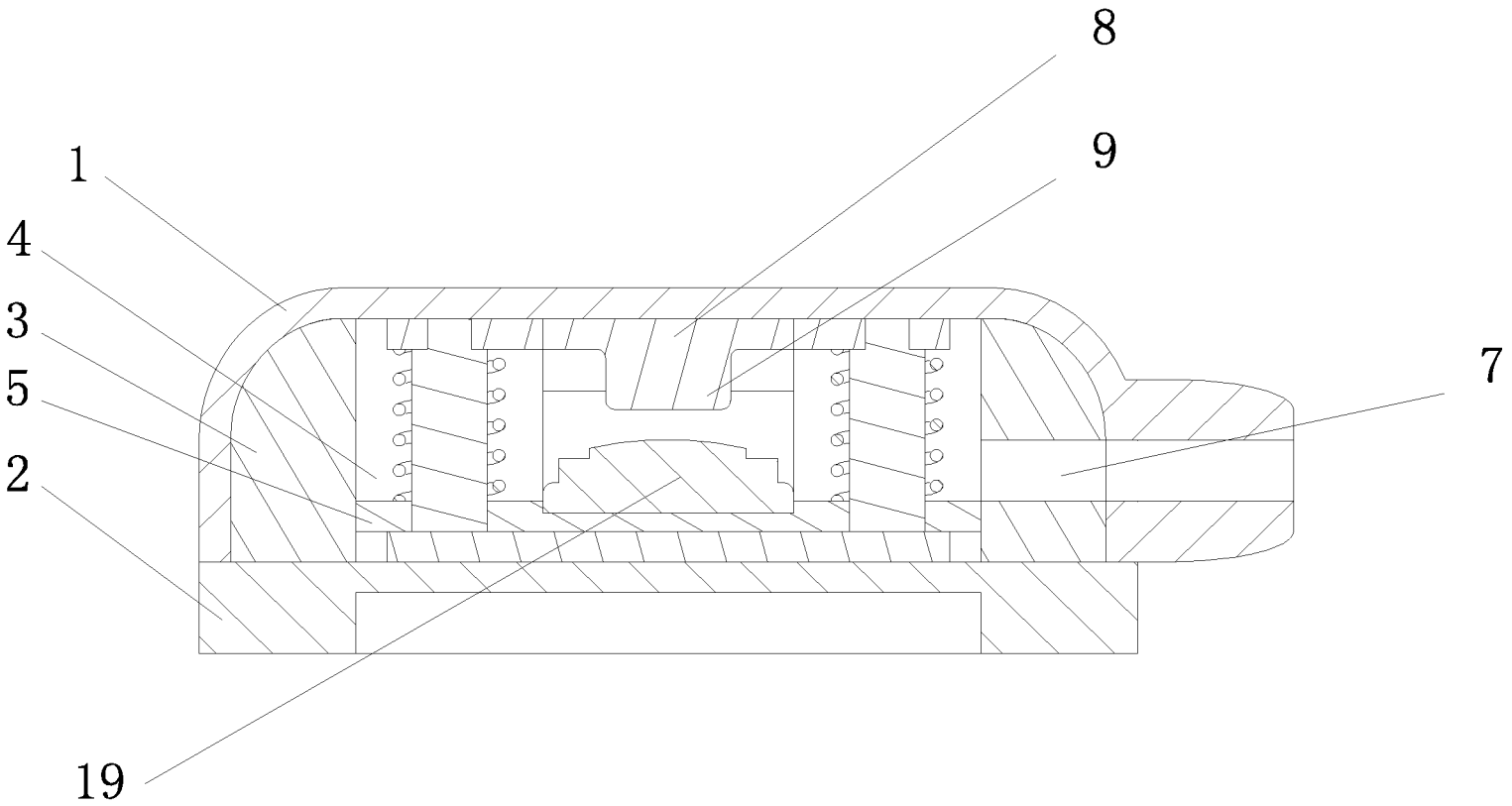
FIG. 13 is a sectional view for a front view of a fifth embodiment of the present invention.

As shown in FIG. 13, a underwater high-sensitivity button switch includes an upper cover 1, a lower cover 2 and a hollow block 3.

The upper cover 1 and the lower cover 2 are made of an elastic material.

The hollow block 3 is made of a rigid material.

Two ends of a through hole 4 of the hollow block 3 are respectively sealed by the upper cover 1 and the lower cover 2.

A mounting block 5 is held in the through hole 4 of the hollow block 3, and the mounting block 5 is horizontally arranged and is fixedly connected with the inner wall of the through hole 4.

A normally open/normally closed button switch 19 is fixedly arranged on the mounting block 5; the normally open/normally closed button switch 19 is connected with a conducting wire; and a wire penetration hole 7 for allowing the conducting wire to enter is provided on the hollow block 3.

A button fixing seat 8 is held in the through hole 4 of the hollow block 3, and the button fixing seat 8 is fixedly provided with a button cap 9.

The button cap 9 is positioned above the normally open/normally closed button switch 19.

A guiding apparatus for enabling the button cap 9 to move relative to the normally open/normally closed button switch 19 is held in the through hole 4 of the hollow block 3, and a moving part fixedly connected with the button fixing seat 8 is arranged in the guiding apparatus.

The moving part drives the button cap 9 to move relative to the normally open/normally closed button switch 19, so that the button cap contacts or is separated from the normally open/normally closed button switch 19.

Two ends of the moving part are respectively propped against the inner walls of the upper cover 1 and the inner cover 2; pressures that the water pressure is transferred to the two ends of the moving part via the upper cover 1 and the lower cover 2 are equal; and under a condition in which the moving part is stressed by the water pressure and is not stressed by other external forces, a position of the moving part is constant, that is, a distance of the button cap 9 relative to the normally open/normally closed button switch 19 is constant.

After the moving part is pressed, the button cap 9 is driven to move downward and the button cap 9 squeezes the normally open button switch, so that the connection of the circuit is implemented. If the button cap 9 squeezes the normally closed button switch, the disconnection of the circuit of the conducting wires is implemented.

Embodiment 6

Figure 14:
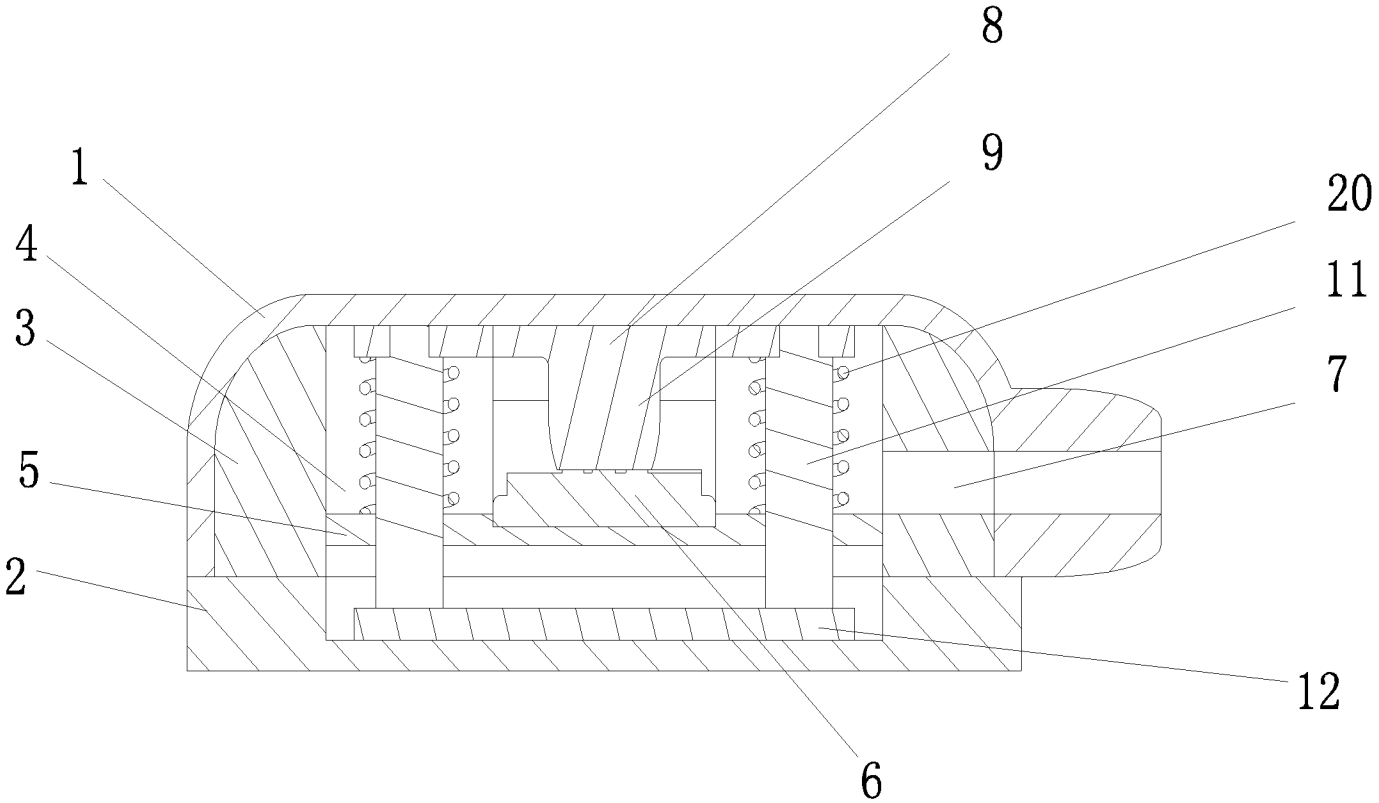
FIG. 14 is a sectional view for a front view of a sixth embodiment of the present invention.

As shown in FIG. 14, a underwater high-sensitivity button switch includes an upper cover 1, a lower cover 2 and a hollow block 3.

The upper cover 1 and the lower cover 2 are made of an elastic material.

The hollow block 3 is made of a rigid material.

Two ends of a through hole 4 of the hollow block 3 are respectively sealed by the upper cover 1 and the lower cover 2.

A bridge-cutoff block 6 arranged horizontally and fixedly connected with the inner wall of the through hole 4 is held in the through hole 4 of the hollow block 3; the bridge-cutoff block 6 is made of a conductive material; two unconnected lug bosses are arranged on the bridge-cutoff block 6; and the two lug bosses are respectively and electrically connected with an operating product.

A button cap 9 is held in the through hole 4 of the hollow block 3.

The button cap 9 is made of a conductive material. The button cap 9 is positioned above the bridge-cutoff block 6, and the button cap 9 contacts the bridge-cutoff block 6.

A guiding apparatus for enabling the button cap 9 to move relative to the bridge-cutoff block 6 is held in the through hole 4 of the hollow block 3, and a moving part fixedly connected with the button cap 9 is arranged in the guiding apparatus.

The moving part drives the button cap 9 to move relative to the bridge-cutoff block 6; the button cap contacts the bridge-cutoff block 6 to implement connection of a circuit; and the button cap is separated from the bridge-cutoff block 6 to implement disconnection of the circuit.

Two ends of the moving part are respectively propped against the inner walls of the upper cover 1 and the inner cover 2; pressures that the water pressure is transferred to the two ends of the moving part via the upper cover 1 and the lower cover 2 are equal; and under a condition in which the moving part is stressed by the water pressure and is not stressed by other external forces, a position of the moving part is constant, that is, a distance of the button cap 9 relative to the bridge-cutoff block 6 is constant.

Preferably, a mounting block 5 is held in the through hole 4 of the hollow block 3; the mounting block 5 is horizontally arranged and is fixedly connected with the inner wall of the through hole 4; and the bridge-cutoff block 6 is fixedly arranged on the mounting block 5.

Preferably, the two lug bosses are respectively connected with a conducting wire; the conducting wires are connected with the operating product; and wire penetration holes 7 for allowing the conducting wires to enter are provided on the hollow block 3.

Preferably, a button fixing seat 8 is held in the through hole 4 of the hollow block 3; the button fixing seat 8 is fixedly connected with the moving part; and the button fixing seat 8 is fixedly provided with the button cap 9.

Preferably, a tensile spring 20 is arranged between the button fixing seat 8 and the mounting block 5, so that the button cap 9 tightly contacts the bridge-cutoff block 6.

Preferably, the guiding apparatus includes two round holes formed on the mounting block 5.

The moving part is two vertical rods 11, and the two vertical rods 11 are simultaneously and fixedly connected with the button fixing seat 8.

The vertical rods 11 are respectively held in the two round holes 10; and two ends of the two vertical rods 11 are respectively propped against the inner walls of the upper cover 1 and the lower cover 2.

Preferably, the button fixing seat 8 is arranged at top ends of the vertical rods 11, and is propped against the inner wall of the upper cover 1; and wire penetration holes 7 for allowing the conducting wires to enter are provided on the upper cover 1.

Preferably, a button block 12 is further arranged at bottom ends of the vertical rods 11; and the bottom block 12 is propped against the inner wall surface of the lower cover 2.

When the present invention is applied to underwater, the upper cover 1 and the lower cover 2 are made of an elastic material and the water pressures stressed at places where the two ends of the moving rod are respectively propped against the inner walls of the upper cover 1 and the lower cover 2 are equal, that is, under the condition in which the moving rod is not stressed by the external force, the effect that the moving rod is constant is implemented, the button cap 9 on the moving rod contacts a bridge-cutoff platform and the circuit is in a connection state; by pressing the moving rod on the outer wall of the lower cover 2, the moving rod drives the button cap 9 to move, the button cap 9 is promoted to separate from the bridge-cutoff platform and the circuit is disconnected; after the moving rod is loosened, the other end of the moving rod is propped against the wall surface of a housing to restore the deformation and during the restoration, the moving rod is propped against to move, the button cap 9 on the moving rod contacts the bridge-cutoff platform again and the circuit is restored to the connection state; and after the water pressures stressed at the places where the two ends of the moving rod are respectively propped against the inner walls of the upper cover 1 and the lower cover 2 are equal, under the condition in which the moving rod is stressed by the water pressure and is not stressed by other external forces, the position is constant again, that is, the button cap 9 contacts the bridge-cutoff block 6.

The above embodiments only are several implementation manners of the present invention and the description is relatively specific and detailed and cannot be understood as the limitation to the scope of protection of the utility mode. It is to be noted that those of ordinary skill in the art further may make a plurality of alternations and improvements without departing from the concepts of the present invention and all pertain to the scope of protection of the present invention. Therefore, the scope of protection of the present invention shall be subjected to the appended claims.

What is claimed is:

1. An underwater high-sensitivity button switch, comprising an upper cover, a lower cover and a hollow block, wherein the upper cover and the lower cover are made of an elastic material;

the hollow block is made of a rigid material;

two ends of a through hole of the hollow block are respectively sealed by the upper cover and the lower cover;

a mounting block is held in the through hole of the hollow block; the mounting block is horizontally arranged and is fixedly connected with the inner wall of the through hole;

a normally open/normally closed button switch is fixedly arranged on the mounting block; the normally open/normally closed button switch is connected with a conducting wire;

a wire penetration hole for allowing the conducting wire to enter is provided on the hollow block;

a button fixing seat is held in the through hole of the hollow block; the button fixing seat is fixedly provided with a button cap;

the button cap is positioned above the normally open/normally closed button switch;

a guiding apparatus for enabling the button cap to move relative to the normally open/normally closed button switch is held in the through hole of the hollow block, and a moving part fixedly connected with the button fixing seat is arranged in the guiding apparatus;

two ends of the moving part are respectively propped against the inner walls of the upper cover and the lower cover; pressures that the water pressure is transferred to the two ends of the moving part via the upper cover and the lower cover are equal; and under a condition in which the moving part is stressed by the water pressure and is not stressed by other external forces, a position of the moving part is constant, that is, a distance of the button cap relative to the normally open/normally closed button switch is constant; and when the moving part is stressed by the other external forces, the moving part drives the button cap to move relative to the normally open/normally closed button switch, so that the button cap contacts the normally open/normally closed button switch; and when the other external forces are removed, the moving part drives the button cap to move relative to the normally open/normally closed button switch, so that the button cap is separated from the normally open/normally closed button switch.

2. The underwater high-sensitivity button switch as claimed in claim 1, wherein compression springs are further arranged on sections, between the button fixing seat and the mounting block, of the vertical rods in a sleeving manner.

3. The underwater high-sensitivity button switch as claimed in claim 1, wherein the upper cover and the lower cover are made of a rubber, a silica gel or a latex material.

4. The underwater high-sensitivity button switch as claimed in claim 1, wherein the guiding apparatus comprises two round holes formed on the mounting block;

the moving part is two vertical rods; the two vertical rods are simultaneously and fixedly connected with the button fixing seat; and the vertical rods are respectively held in the two round holes; and two ends of the two vertical rods are respectively propped against the inner walls of the upper cover and the lower cover.

5. The underwater high-sensitivity button switch as claimed in claim 4, wherein the button fixing seat is arranged at top ends of the vertical rods, and is propped against the inner wall surface of the upper cover; and wire penetration holes for allowing the conducting wires to enter are provided on the upper cover.

6. The underwater high-sensitivity button switch as claimed in claim 4, wherein two vertical rods are provided; and the two vertical rods are symmetrically arranged relative to the button cap.

7. The underwater high-sensitivity button switch as claimed in claim 4, wherein a bottom block is further arranged at bottom ends of the vertical rods; and the bottom block is propped against the inner wall surface of the lower cover.

8. The underwater high-sensitivity button switch as claimed in claim 7, wherein the vertical rods, the button fixing seat and the bottom block all are made of a Polyacetal (POM) material.

9. An underwater high-sensitivity button switch, comprising an upper cover, a lower cover and a hollow block, wherein the upper cover and the lower cover are made of an elastic material;

the hollow block is made of a rigid material;

two ends of a through hole of the hollow block are respectively sealed by the upper cover and the lower cover;

a bridge-cutoff block arranged horizontally and fixedly connected with the inner wall of the through hole is held in the through hole of the hollow block; the bridge-cutoff block is made of a conductive material; two unconnected lug bosses are arranged on the bridge-cutoff block;

a button cap is held in the through hole of the hollow block;

the button cap is made of a conductive material; the button cap is positioned above the bridge-cutoff block;

a guiding apparatus for enabling the button cap to move relative to the bridge-cutoff block is held in the through hole of the hollow block, and a moving part fixedly connected with the button cap is arranged in the guiding apparatus;

two ends of the moving part are respectively propped against the inner walls of the upper cover and the lower cover; pressures that the water pressure is transferred to the two ends of the moving part via the upper cover and the lower cover are equal; and under a condition in which the moving part is stressed by the water pressure and is not stressed by other external forces, a position of the moving part is constant, that is, a distance of the button cap relative to the bridge-cutoff block is constant; and when the moving part is stressed by the other external forces, the moving part drives the button cap to move relative to the normally open/normally closed button switch, so that the button cap contacts the normally open/normally closed button switch; and when the other external forces are removed, the moving part drives the button cap to move relative to the normally open/normally closed button switch, so that the button cap is separated from the normally open/normally closed button switch.

10. The underwater high-sensitivity button switch as claimed in claim 9, wherein the upper cover and the lower cover are made of a rubber, a silica gel or a latex material.

11. The underwater high-sensitivity button switch as claimed in claim 9, wherein a mounting block is held in the through hole of the hollow block; the mounting block is horizontally arranged and is fixedly connected with the inner wall of the through hole; and the bridge-cutoff block is fixedly arranged on the mounting block.

12. The underwater high-sensitivity button switch as claimed in claim 11, wherein a limiting block is further arranged in the through hole of the hollow block; and when the button cap is overlapped to the two lug bosses, the limiting block limits the movement of the button fixing seat and controls the degree of compaction of the button cap to the lug bosses.

13. The underwater high-sensitivity button switch as claimed in claim 11, wherein the button cap and the bridge-cutoff block both are made of a copper material.

14. The underwater high-sensitivity button switch as claimed in claim 11, wherein a button fixing seat is held in the through hole of the hollow block; the button fixing seat is fixedly connected with the moving part; and the button fixing seat is fixedly provided with the button cap.

15. The underwater high-sensitivity button switch as claimed in claim 14, wherein compression springs are further arranged on sections, between the button fixing seat and the mounting block, of the vertical rods in a sleeving manner.

16. The underwater high-sensitivity button switch as claimed in claim 14, wherein the guiding apparatus comprises two round holes formed on the mounting block;

the moving part is two vertical rods; the two vertical rods are simultaneously and fixedly connected with the button fixing seat; and the vertical rods are respectively held in the two round holes; and two ends of the two vertical rods are respectively propped against the inner walls of the upper cover and the lower cover.

17. The underwater high-sensitivity button switch as claimed in claim 16, wherein the button fixing seat is arranged at top ends of the vertical rods, and is propped against the inner wall surface of the upper cover; and wire penetration holes for allowing the conducting wires to enter are provided on the upper cover.

18. The underwater high-sensitivity button switch as claimed in claim 16, wherein a bottom block is further arranged at bottom ends of the vertical rods; and the bottom block is propped against the inner wall surface of the lower cover.

19. The underwater high-sensitivity button switch as claimed in claim 16, wherein two vertical rods are provided; and the two vertical rods are symmetrically arranged relative to the button cap.

* * * * *